US008103505B1

(12) United States Patent
Silverman et al.

(10) Patent No.: US 8,103,505 B1
(45) Date of Patent: Jan. 24, 2012

(54) METHOD AND APPARATUS FOR SPEECH SYNTHESIS USING PARALINGUISTIC VARIATION

(75) Inventors: Kim Silverman, Mountain View, CA (US); Donald Lindsay, Mountain View, CA (US)

(73) Assignee: Apple Inc., Cupertino, CA (US)

( * ) Notice: Subject to any disclaimer, the term of this patent is extended or adjusted under 35 U.S.C. 154(b) by 1127 days.

(21) Appl. No.: 10/718,140

(22) Filed: Nov. 19, 2003

(51) Int. Cl.
*G10L 13/08* (2006.01)

(52) U.S. Cl. ..... 704/260; 704/258; 704/268

(58) Field of Classification Search ..... 704/258, 704/260, 268
See application file for complete search history.

(56) References Cited

U.S. PATENT DOCUMENTS 4,908,867 A 3/1990 Silverman
5,007,095 A * 4/1991 Nara et al. ..... 704/261
5,384,893 A * 1/1995 Hutchins ..... 704/267
5,652,828 A 7/1997 Silverman
5,732,395 A 3/1998 Silverman
5,749,071 A * 5/1998 Silverman ..... 704/260
5,751,906 A 5/1998 Silverman
5,832,433 A 11/1998 Yashchin et al.
5,832,435 A 11/1998 Silverman
5,860,064 A * 1/1999 Henton ..... 704/260
5,875,427 A * 2/1999 Yamazaki ..... 704/258
5,890,117 A 3/1999 Silverman
6,064,960 A 5/2000 Bellegarda et al.
6,101,470 A * 8/2000 Eide et al. ..... 704/260
6,185,533 B1 * 2/2001 Holm et al. ..... 704/267
6,208,971 B1 3/2001 Bellegarda et al.
6,226,614 B1 * 5/2001 Mizuno et al. ..... 704/260
6,289,301 B1 * 9/2001 Higginbotham et al. ..... 704/1
6,334,103 B1 * 12/2001 Surace et al. ..... 704/257
6,366,884 B1 * 4/2002 Bellegarda et al. ..... 704/266
6,374,217 B1 4/2002 Bellegarda
6,397,183 B1 * 5/2002 Baba et al. ..... 704/260
6,405,169 B1 * 6/2002 Kondo et al. ..... 704/258
6,424,944 B1 * 7/2002 Hikawa ..... 704/260
6,477,488 B1 11/2002 Bellegarda
6,499,014 B1 * 12/2002 Chihara ..... 704/260
6,553,344 B2 * 4/2003 Bellegarda et al. ..... 704/267
6,708,153 B2 * 3/2004 Brittan et al. ..... 704/260
6,804,649 B2 * 10/2004 Miranda ..... 704/258
6,970,820 B2 * 11/2005 Junqua et al. ..... 704/258
7,065,485 B1 * 6/2006 Chong-White et al. ..... 704/208
(Continued)

OTHER PUBLICATIONS

Jerome R. Bellegarda, "Method and Apparatus for Speech Recognition Using Semantic Interference and Word Agglomeration," U.S. Patent Application, Filed on Oct. 13, 2000, U.S. Appl. No. 09/688,010, pp. 1-40.

(Continued)

*Primary Examiner* — Douglas Godbold
(74) *Attorney, Agent, or Firm* — Blakely, Sokoloff, Taylor & Zafman LLP

(57) ABSTRACT

A method and apparatus for speech synthesis in a computer-user interface using random paralinguistic variation is described herein. According to one aspect of the present invention, a method for synthesizing speech comprises generating synthesized speech having certain prosodic features. The synthesized speech is further processed by applying a random paralinguistic variation to the acoustic sequence representing the synthesized speech without altering the linguistic prosodic features. According to one aspect of the present invention, the application of the paralinguistic variation is correlated with a previously applied paralinguistic variation to reflect a gradual change in the computer voice, while still maintaining a random quality.

62 Claims, 7 Drawing Sheets

U.S. PATENT DOCUMENTS

| | | | | |
|---|---|---|---|---|
| 7,096,183 | B2 * | 8/2006 | Junqua | 704/258 |
| 7,103,548 | B2 * | 9/2006 | Squibbs et al. | 704/260 |
| 7,127,396 | B2 * | 10/2006 | Chu et al. | 704/258 |
| 2001/0032080 | A1 * | 10/2001 | Fukada | 704/258 |
| 2002/0026315 | A1 * | 2/2002 | Miranda | 704/258 |
| 2002/0138270 | A1 * | 9/2002 | Bellegarda et al. | 704/266 |
| 2002/0193996 | A1 * | 12/2002 | Squibbs et al. | 704/260 |
| 2003/0078780 | A1 * | 4/2003 | Kochanski et al. | 704/258 |
| 2003/0163316 | A1 * | 8/2003 | Addison et al. | 704/260 |
| 2004/0193421 | A1 * | 9/2004 | Blass | 704/258 |
| 2004/0249667 | A1 * | 12/2004 | Oon | 705/2 |

OTHER PUBLICATIONS

"Speech Synthesis Markup Language Specification for the Speech Interface Framework," W3C Working Draft, Aug. 8, 2000, pp. 1-42, <w3.org/TR/2000/WD-speech-synthesis-20000808>, retrieved from WWW on Dec. 14, 2000.

Allen L. Gorin, et al., "Automated Natural Spoken Dialog," Computer, Apr. 2002, vol. 35, No. 4, pp. 51-56.

Kim E.A. Silverman, "The Structure and Processing of Fundamental Frequency Contours," University of Cambridge Doctoral Thesis, Apr. 1987, pp. 1-189.

* cited by examiner

METHOD AND APPARATUS FOR SPEECH SYNTHESIS USING PARALINGUISTIC VARIATION

FIELD OF THE INVENTION

The present invention relates generally to speech synthesis systems. More particularly, this invention relates to generating variations in synthesized speech to produce speech that sounds more natural.

COPYRIGHT NOTICE/PERMISSION

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever. The following notice applies to the software and data as described below and in the drawings hereto: Copyright© 2002, Apple Computer, Inc., All Rights Reserved.

BACKGROUND OF THE INVENTION

Speech is used to communicate information from a speaker to a listener. In a computer-user interface, the computer generates synthesized speech to convey an audible message to the user rather than just displaying the message as text with an accompanying "beep." There are several advantages to conveying audible messages to the computer user in the form of synthesized speech. In addition to liberating the user from having to look at the computer's display screen, the spoken message conveys more information than the simple "beep" and, for certain types of information, speech is a more natural communication medium.

Due to the nature of computer systems, the same message may occur many times. For example, the message "Attention! The printer is out of paper" may be programmed to repeat several times over a short period of time until the user replenishes the printer's paper tray. Or the message "Are you sure you want to quit without saving?" may be repeated several times over the course of using a particular program. In human speech, when a person says the same words over and over again, he or she does not produce exactly the same acoustic signal each time the words are spoken. In synthesized speech, however, the opposite is true; a computer generates exactly the same acoustic signal each time the message is spoken. Users inevitably become annoyed at hearing the same predictable message spoken each time in exactly the same way. The more often a particular message is spoken in exactly the same way, the more unnaturally mechanical it sounds. In fact, studies have shown that listeners tune out repetitive sounds and, eventually, a repetitive spoken message will not be noticed.

One way to overcome the problems of sound repetition is to alter the way the computer produces the acoustic signal each time the message is spoken. Altering a computer-generated sound each time it is produced is known in the art. For example, alteration of the sound can be achieved by changing the sample playback rate, which shifts the overall spectrum and duration of the acoustic signal. While this approach works well for non-speech sounds, it does not work well when applied to speech sounds. In human speech, the overall spectrum of sound stays the same because a human speaker's vocal tract length does not vary. Thus, in order to sound like human speech, the overall spectrum of the sound of synthesized speech needs to stay the same as well. Another prior art example of altering a computer-generated sound each time it is produced is found in computer-generated music. In computer music a small random variation in the timing of each note is sometimes made to achieve a less mechanical sound. However, as with changing the sample playback rate, changing the timing of the components of speech does not work well for speech sounds because, unlike music, speech does not consist of easily identifiable note-onset and note-duration events. Rather, speech consists of tonal patterns of pitch, syllable stresses, overlapped gestures of the articulators (tongue, lips, jaw, etc.), and timing to form the rhythmic speech patterns that comprise the spoken message. Thus, it is not so clear exactly what parameters in speech synthesis should be varied to achieve a more natural sound. A more detailed analysis of the components of speech is required.

Speech is the acoustic output of a complex system whose underlying state consists of a known set of discrete phonemes that every human speaker produces. A phoneme is the basic theoretical unit for describing how speech conveys linguistic meaning. As such, the phonemes of a language comprise a minimal theoretical set of units that are sufficient to convey all meaning in the language. For American English, there are approximately 40 phonemes, which are made up of vowels and consonants. Each phoneme can be considered to be a code that consists of a unique set of articulatory gestures.

If speakers could exactly and consistently produce these phoneme sounds, speech would amount to a stream of underlying discrete codes. However, because of many different factors including, for example, agents, gender, and coarticulatory effects, every phoneme has a variety of acoustic manifestations in the course of flowing speech. Thus, from an acoustical point of view, the phoneme actually represents a class of sounds that convey the same meaning.

The variations in the way the phonemes are produced between people and even between utterances of the same person are referred to as prosody. Examples of prosody include tonal and rhythmic variations in speech, which provide a significant contribution to the formal linguistic structure of speech communication and are referred to as the prosodic features. The acoustic patterns of prosodic features are heard in changes in the duration, intensity, fundamental frequency, and spectral patterns of the individual phonemes that comprise the spoken message.

There are two distinctive components of prosody—i.e., linguistic components of prosody and paralinguistic components of prosody. The linguistic components of prosody are those that can change the meaning of a spoken phrase. In contrast, paralinguistic components of prosody are those that do not change the meaning of a series of spoken words. For example, when speaking the phrase "it's raining," a rising intonation asks for a confirmation and, perhaps, conveys surprise or disbelief. On the other hand, a falling intonation may express confidence that the rain is indeed falling. The distinction between the rising and falling intonations is an example of varying a linguistic prosodic feature. By contrast, one could speak the phrase "it's raining" with a somewhat higher (or lower) overall pitch range, depending upon whether the listener is far away (or nearby), and this change in overall pitch range does not change the meaning of the spoken words. Such a change in pitch without altering meaning is an example of a paralinguistic prosodic feature.

The fundamental frequency contours of speech have been classified according to their communicative function. In English, a rising contour generally conveys to the listener that a question has been posed, that some response from the listener is required, or that more information is implied to follow within the current topic. Conversely, a falling contour generally conveys the opposite. Numerous subtle and not-so-subtle variations in the fundamental frequency contours signal other information to the listener as well, such as sarcasm, disbelief, excitement or anger. Unlike the phonemes, the prosodic features reflected in the acoustic patterns may not be discrete. In fact, it is often difficult or impossible to determine which features of prosody are discrete and which are not.

The human ear is extremely sensitive to minor changes in certain components of speech, and remarkably tolerant of other changes. For example, the tonal and rhythmic variations of speech are finely controlled by humans and, as noted above, convey considerable linguistic information. Thus, random variations in the pitch or duration of each phoneme, syllable or word of a spoken message can destructively interfere with the overall tonal and rhythmic pattern of the speech, i.e. the prosody. Even a 9-millisecond difference in the closure duration of an inter-vocal stop can shift the perception from voiced to voiceless, changing for example the word "rapid" into "rabid." Therefore, simply changing the parameters for the timing of sound components may result in undesirable alterations in the prosodic features of the phonemes that comprise the speech and cannot be successfully applied to speech synthesis.

Another example of altering computer-generated sounds is disclosed in U.S. Pat. No. 5,007,095 to Nara et al., which describes a system for synthesizing speech having improved naturalness.

SUMMARY OF THE INVENTION

A method and apparatus for generating speech that sounds more natural using paralinguistic variation is described herein. According to one aspect of the present invention, a method for generating speech that sounds more natural comprises generating synthesized speech having certain prosodic features and applying a paralinguistic variation to the acoustic sequence representing the synthesized speech without altering the linguistic prosodic features. According to one aspect of the present invention, the application of the paralinguistic variation is correlated with a previous randomly applied paralinguistic variation to reflect a gradual change in the computer voice, while still maintaining a random quality. According to one aspect of the present invention, the application of the paralinguistic variation is correlated over time. According to one aspect of the present invention, the application of the paralinguistic variation is correlated with other paralinguistic variations, sometimes in accordance with a predetermined paragraph prosody.

According to one aspect of the present invention, a machine-accessible medium has stored thereon a plurality of instructions that, when executed by a processor, cause the processor to alter synthesized speech by applying a paralinguistic variation to the acoustic sequence representing the synthesized speech without altering the linguistic prosodic features. According to another aspect of the invention, the application of the paralinguistic variation is correlated with a previous randomly applied paralinguistic variation to reflect a gradual change in the computer voice, while still maintaining a random quality. According to one aspect of the present invention, the instructions cause the processor to correlate the application of the paralinguistic variation over time. According to one aspect of the present invention, the instructions cause the processor to correlate the paralinguistic variation with other paralinguistic variations, sometimes in accordance with a predetermined paragraph prosody.

According to one aspect of the present invention, an apparatus for applying a paralinguistic variation to an acoustic sequence representing synthesized speech without altering the prosodic features of the synthesized speech includes a speech synthesizer and a paralinguistic variation processor. The speech synthesizer generates synthesized speech having certain prosodic features and the paralinguistic variation processor applies paralinguistic variations to the acoustic sequence representing the synthesized speech without altering the prosodic features. According to one aspect of the present invention, the paralinguistic variation processor correlates the paralinguistic variations with a previous randomly applied paralinguistic variation to reflect a gradual change in the computer voice, while still maintaining a random quality. According to one aspect of the present invention, the paralinguistic variation processor correlates the application of the paralinguistic variation over time. According to one aspect of the present invention, the paralinguistic variation processor correlates the paralinguistic variation with other paralinguistic variations, sometimes in accordance with a predetermined paragraph prosody.

In yet another embodiment, an apparatus for applying a paralinguistic variation to an acoustic sequence representing synthesized speech without altering the prosodic features of the synthesized speech comprises analog circuitry.

DETAILED DESCRIPTION

A method and an apparatus for generating paralinguistic variations in a speech synthesis system to produce more natural sounding speech are provided. In the following description, for purposes of explanation, numerous specific details are set forth in order to provide a thorough understanding of the present invention. It will be evident, however, to one skilled in the art that the present invention may be practiced without these specific details. In other instances, well-known structures and devices are shown in block diagram form in order to avoid unnecessarily obscuring the present invention.

Figure 1:
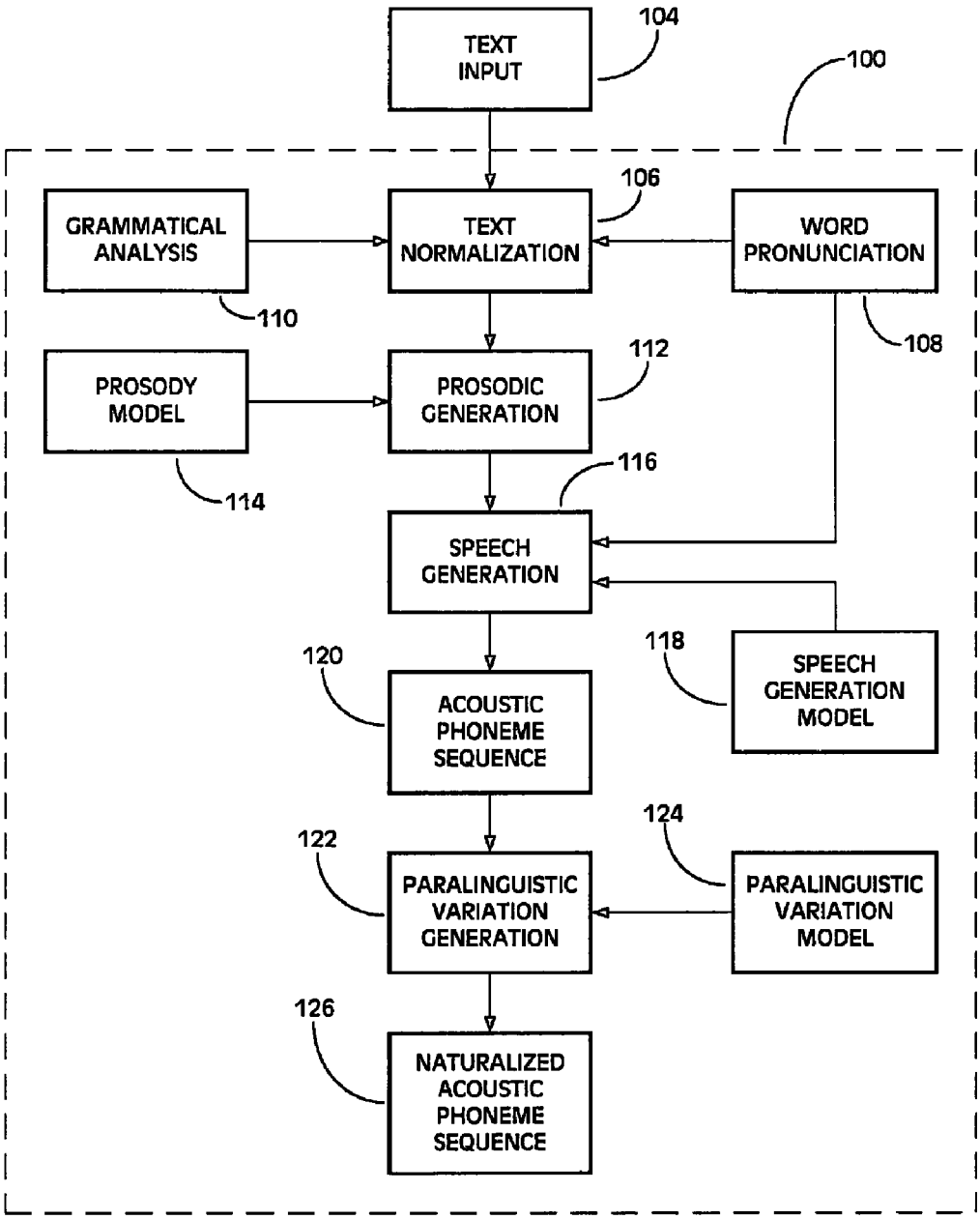
FIG. 1 is a block diagram illustrating one generalized embodiment of a speech synthesis system incorporating the invention, and the operating environment in which certain aspects of the illustrated invention may be practiced.

FIG. 1 is a block diagram illustrating one generalized embodiment of a speech synthesis system 100 incorporating the invention, and the operating environment in which certain aspects of the illustrated invention may be practiced. The speech synthesis system 100 receives a text input 104 and performs a text normalization 106 on the text input 104 using grammatical analysis 110 and word pronunciation 108 processes. For example if the text input 104 is the phrase "½," the text is normalized to the phrase "one half," pronounced as "wUHn hAHf." In one embodiment, the speech synthesis system 100 performs prosodic generation 112 for the normalized text using a prosody model 114. The speech synthesis system 100 performs speech generation 116 to generate an acoustic phoneme sequence 120 for the normalized text that embodies the prosodic features representative of the received text 104 in accordance with a speech generation model 118.

Figure 2:
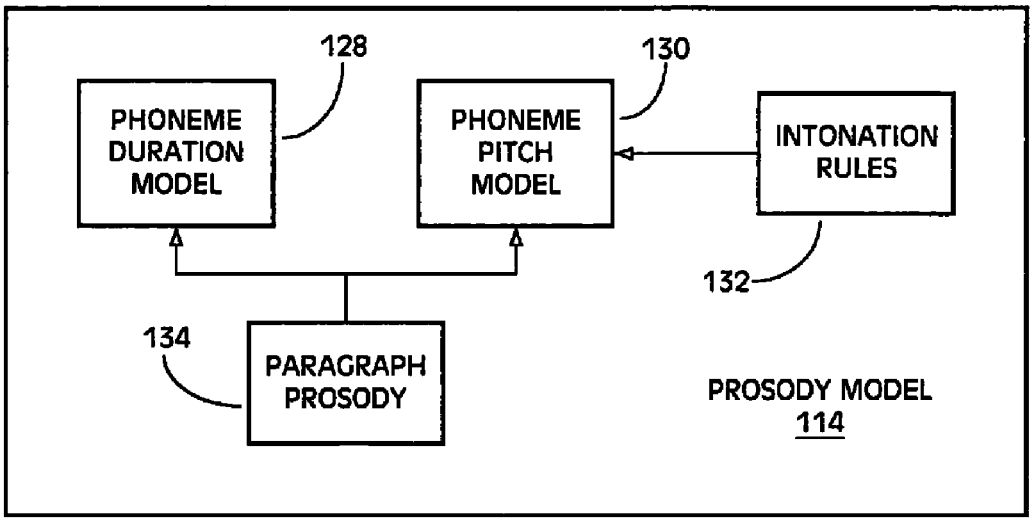
FIG. 2 is a block diagram of a speech synthesis system of an alternate embodiment.

FIG. 2 is a block diagram illustrating a generalized embodiment of the components of a prosody model 114 that may be used in speech synthesis system 100. A phoneme duration model 128 is used by the prosodic generation 112 to provide a duration for each of the initial set of phonemes generated for the normalized text, and a phoneme pitch model 130 is used to provide a pitch or pitch range. In one embodiment, the phoneme pitch model 130 also uses a set of intonation rules 132 to provide pitch information for the phonemes.

In one embodiment the prosodic generation 112 uses a paragraph prosody 134 in conjunction with the phoneme duration model 128 and the phoneme pitch model 130 to provide an overall prosodic pattern for a set of text inputs 104 that comprise a dialog, or other sequence of computer-generated speech. An overall prosodic pattern is beneficial because it can be used to guide the user to respond to the computer-generated speech in a certain way. For example, in a computer-user interface, a task may be automated using a series of voice commands, such as changing the desktop background. The task may involve generating multiple occurrences of speech that prompt the user to enter several commands before the task is completed. The paragraph prosody 134 is used to provide prosodic features to the phonemes that result in speech that helps to guide the user through the task. The overall tonal and rhythmic pattern of the generated speech, i.e. the prosodic features, can help a user to determine whether an additional input is required, whether they must make a choice among alternatives, or when the task is complete.

Referring again to FIG. 1, the speech synthesis system 100 performs the processing necessary to generate an acoustic phoneme sequence 120 for the normalized text that embodies the prosodic features representative of the received text 104. In one embodiment, the speech synthesis system 100 generates paralinguistic variations of the acoustic phoneme sequence 120 in accordance with a paralinguistic variation model 124 resulting in a naturalized acoustic phoneme sequence 126 that sounds more natural or less annoyingly mechanical than the acoustic phoneme sequence 120. The paralinguistic variation generation 122 varies the realization of the individual phonemes that comprise the acoustic phoneme sequence 120, i.e. how the phonemes are mapped onto the acoustic sequence 120, but retains the prosodic features representative of the received text input 104 that were generated using the prosody model 114.

Figure 3:
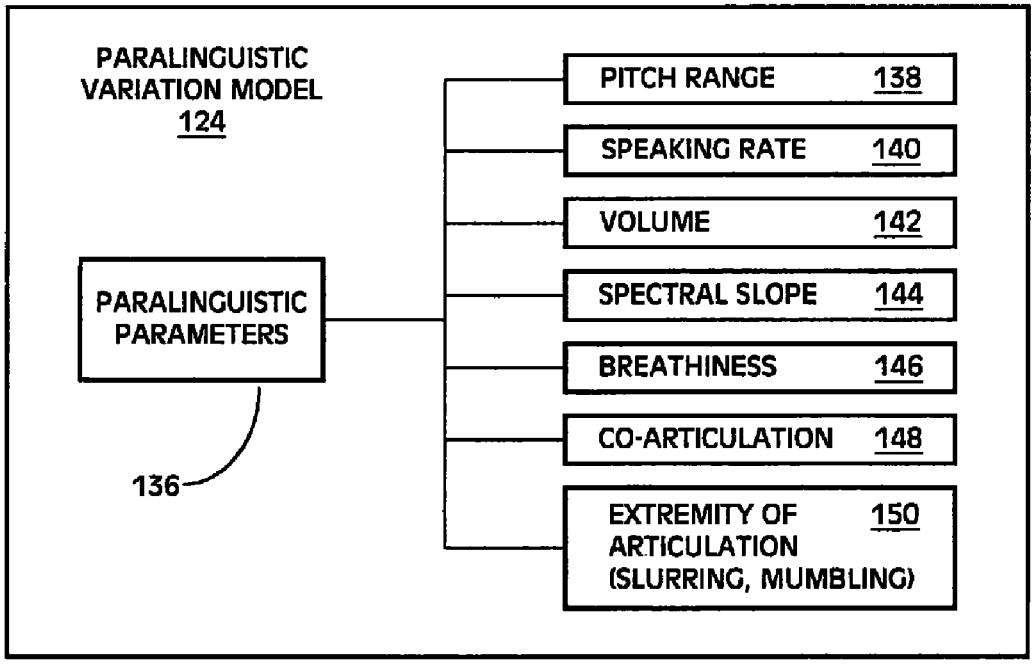
FIG. 3 is block diagram of a speech synthesis system of another alternate embodiment.

FIG. 3 is a block diagram illustrating a generalized embodiment of a paralinguistic variation model 124. A paralinguistic variation may be any one or a combination of any one or more variations of paralinguistic parameters 136 that represent the non-phonemic properties of speech, such as the tonal contours, pitch, or rhythm of speech. Examples of some of the paralinguistic parameters 136 that may be employed in a speech synthesis system 100 incorporating an embodiment of the present invention are illustrated in FIG. 3 and may include the pitch range 138, the speaking rate 140, the volume 142, the spectral slope 144, the breathiness 146, the co-articulation 148, and the extremity of articulation 150, e.g. slurring or mumbling. During paralinguistic variation generation 122, one or more of the paralinguistic parameters 136 is applied to the acoustic phoneme sequence 120 to generate the naturalized acoustic phoneme sequence 126. The application of the paralinguistic parameter(s) 136 may be random or correlated or both as will be described more fully below.

The speech synthesis system 100 may be hosted on a processor, but is not so limited. For an alternate embodiment, the speech synthesis system 100 may comprise some combination of hardware and software that is hosted on a number of different processors. For another alternate embodiment, a number of the components of the speech synthesis system 100 may be hosted on a number of different processors. Another alternate embodiment has a number of different components of the speech synthesis system 100 hosted on a single processor.

In yet a another embodiment, the speech synthesis system 100 is implemented, at least in part, using analog circuitry. For example, the speech synthesis system 100 may be implemented as analog electronic circuits that produce a time-varying electric signal. In one embodiment, a voltage controlled oscillator (VCO) is coupled with one or more voltage controlled filters (VCFs), wherein the output of the VCO is provided to the VCFs. Control inputs to the VCFs can be used to produce different phonemes that represent a sentence that is to be spoken. A time-varying signal can be input to the VCO, and the pattern of voltage (as a function of time) represents the desired pitch contour for the spoken sentence. In such an embodiment, a second input could be provided to the VCO, this second input presenting a slowly-varying random value that is added to the pitch contour to change its overall pitch range in a paralinguistic manner. In a similar fashion, there may be slowly varying inputs to the VCFs that modify, for example, the center-frequency and/or bandwidths of the filter resonances to slightly vary the articulation in random ways.

In yet a further embodiment, various components of the speech synthesis system 100 may be implemented mechanically. For example, the pitch could be generated by a mechanical model of a human larynx, where air is forced through two stretched pieces of rubber. This can produce a pitched buzzing sound having a frequency that is determined by the tightness of the stretched rubber pieces. The buzzing sound could then be passed through a series of tubes whose diameters can be varied over the lengths of the tubes. The tubes, which would resonate at frequencies determined by their respective cross-sectional areas, can produce audible speech. In such an implementation, paralinguistic variations may be achieved using a mechanism that adjusts the tension in the stretched rubber pieces and/or by a mechanism that varies the diameters of the acoustic tubes.

Figure 4:
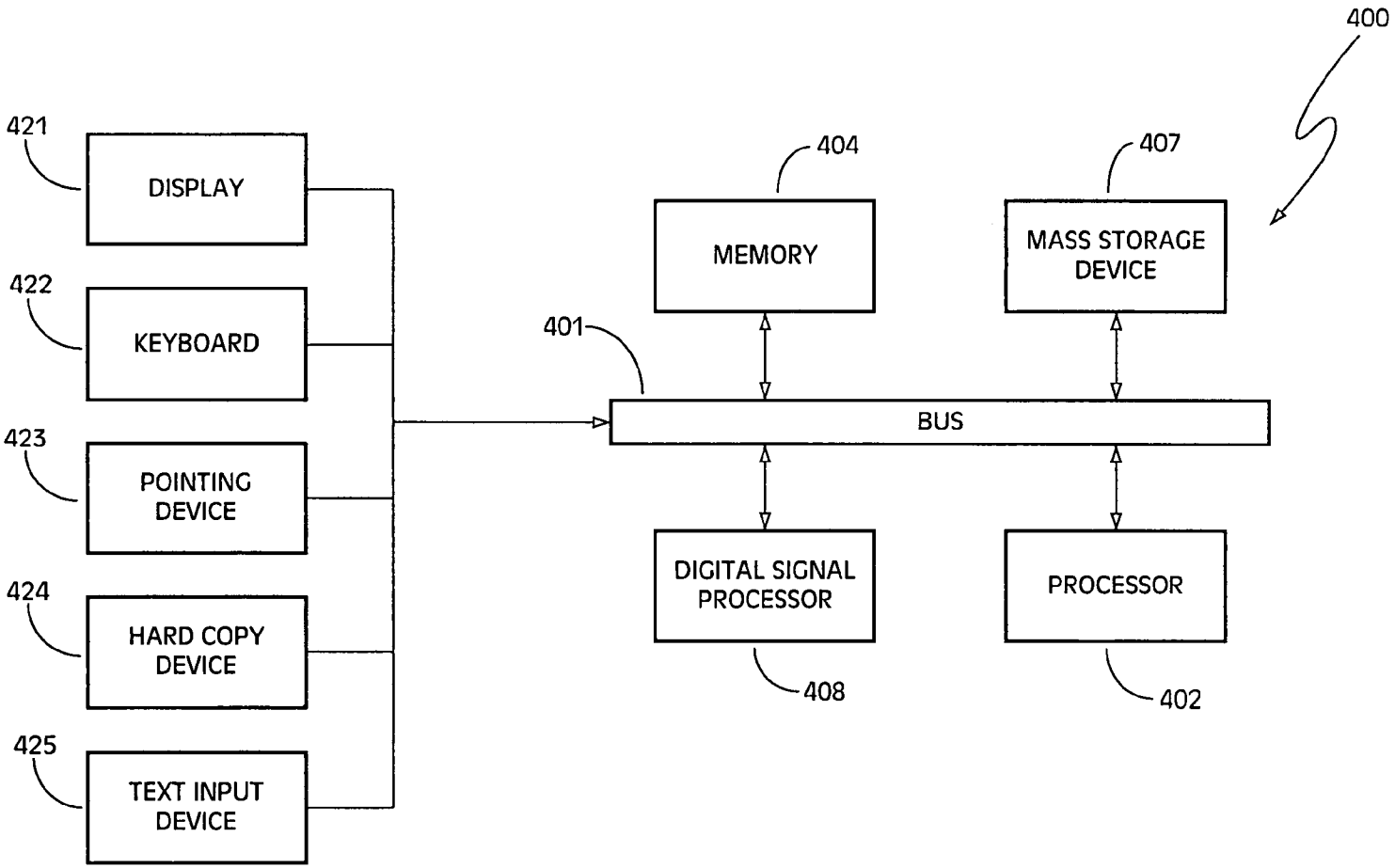
FIG. 4 is a block diagram of a computer system hosting the speech synthesis system of one embodiment.

FIG. 4 illustrates a computer system 400 hosting the speech synthesis system of one embodiment. The computer system 400 comprises, but is not limited to, a system bus 401 that allows for communication among a processor 402, a digital signal processor 408, a memory 404, and a mass storage device 407. The system bus 401 is also coupled to receive inputs from a keyboard 422, a pointing device 423, and a text input device 425, but is not so limited. The system bus 401 provides outputs to a display device 421 and a hard copy device 424, but is not so limited.

These elements 401-425 perform their conventional functions known in the art. Collectively, these elements are intended to represent a broad category of hardware systems, including but not limited to general purpose computer systems based on the PowerPC® processor family of processors available from Motorola, Inc. of Schaumburg, Ill., or the Pentium® processor family of processors available from Intel Corporation of Santa Clara, Calif.

It is to be appreciated that various components of hardware system 400 may be re-arranged, and that certain implementations of the present invention may not require nor include all of the above components. For example, a display device may not be included in system 400. Additionally, multiple buses (e.g., a standard I/O bus and a high performance I/O bus) may be included in system 400. Furthermore, additional components may be included in system 400, such, as additional processors (e.g., a digital signal processor), storage devices, memories, network/communication interfaces, etc.

In the illustrated embodiment of FIG. 4, the method and apparatus for speech synthesis using random paralinguistic variation according to the present invention as discussed above is implemented as a series of software routines run by hardware system 400. These software routines comprise a plurality or series of instructions to be executed by a processor in a hardware system, such as processor 402. Initially, the series of instructions are stored on a storage device of memory 404. It is to be appreciated that the series of instructions can be stored using any conventional storage medium, such as a diskette, CD-ROM, magnetic tape, DVD, ROM, Flash memory, etc. It is also to be appreciated that the series of instructions need not be stored locally, and could be received from a remote storage device, such as a server on a network, via a network/communication interface. The instructions are copied from the storage device, such as mass storage 407, into memory 404 and then accessed and executed by processor 402. In one implementation, these software routines are written in the C++ programming language. It is to be appreciated, however, that these routines may be implemented in any of a wide variety of programming languages.

Figure 5:
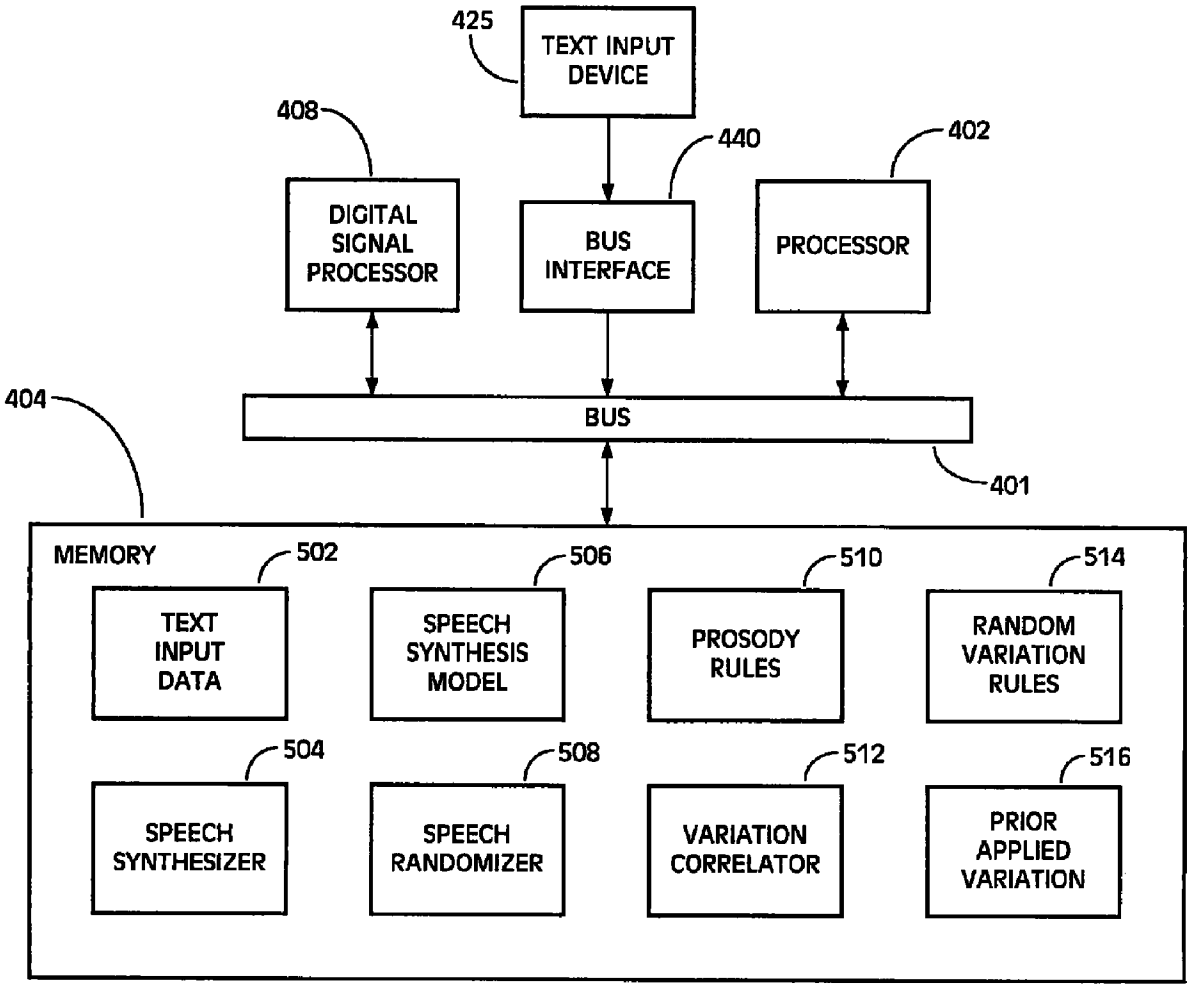
FIG. 5 is a block diagram of a computer system memory hosting the speech synthesis system of one embodiment.

FIG. 5 further illustrates the memory 404 of FIG. 4 in greater detail. The memory 404, which may include and/or be coupled with a memory controller, hosts the speech synthesis system of one embodiment. An input device (e.g., text input device 425) provides text input to a bus interface 440. The bus interface 440 allows for storage of the input text in the text input data memory component 502 in memory 404 via the system bus 401. The text is processed by the processor 402 and/or digital signal processor 408 using algorithms and data associated with the components 502-516 stored in the memory 404. As discussed herein, the components stored in memory 404 that provide the algorithms and data used in processing the text to generate synthetic speech comprise, but not limited to, text input data 502, speech synthesizer 504, speech synthesis model 506, speech randomizer 508, prosody rules 510, variation correlator 512, random variation rules 514, and prior applied variation data 516.

Figure 6:
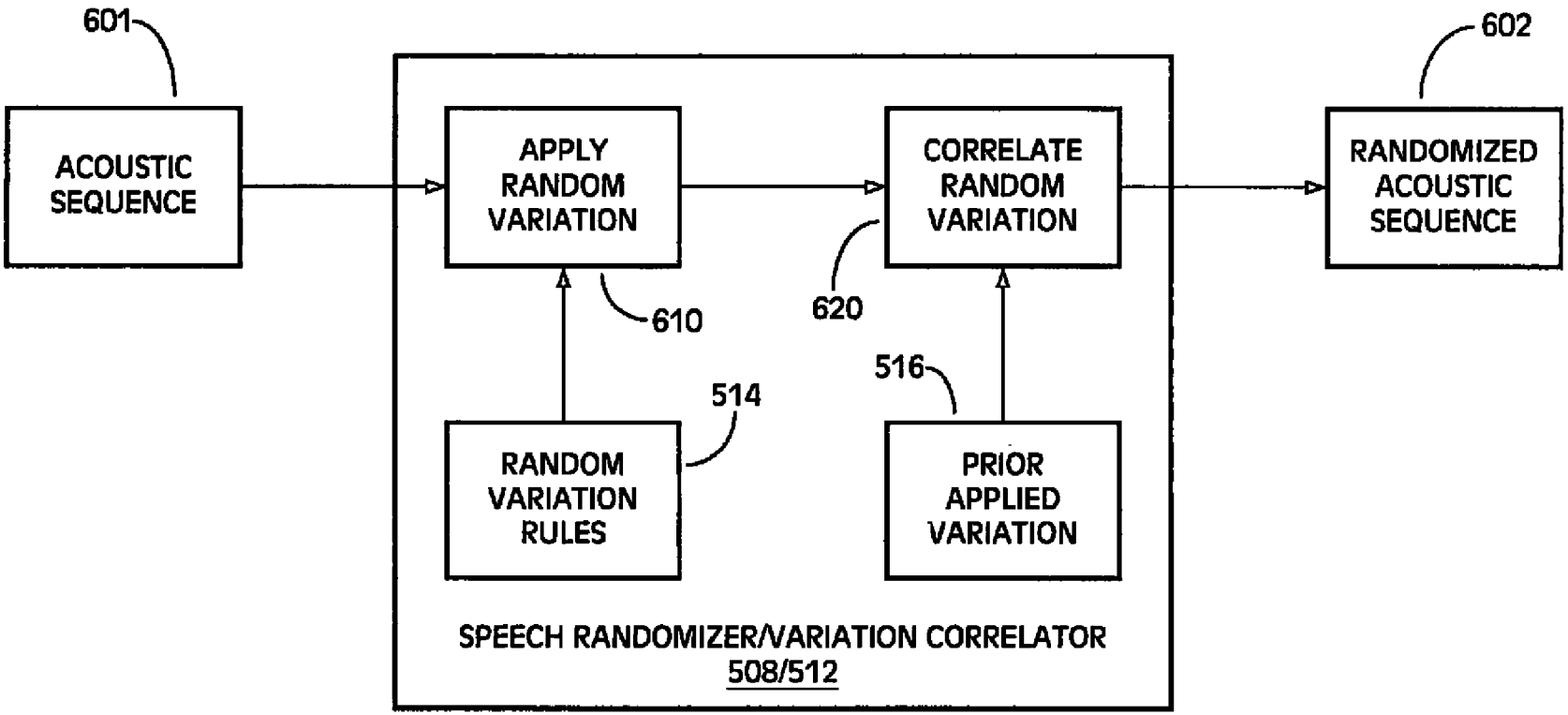
FIG. 6 is a block diagram of a speech randomizer and variation correlator device of a speech synthesis system of one embodiment.

FIG. 6 illustrates a speech randomizer 508 and a variation correlator 512 of a speech synthesis system of one embodiment. An acoustic sequence 601 as generated by a speech synthesizer 504 is processed to apply a random variation 610 selected at random from the random variation rules 514 stored in memory 404. In some instances the random variation is correlated 620 with a prior applied variation 516 stored in memory 404 to reflect a gradual change in the computer voice. In one embodiment, the resulting randomized acoustic sequence 602 is then used to produce a spoken message as part of a talking computer-user interface.

Figure 7:
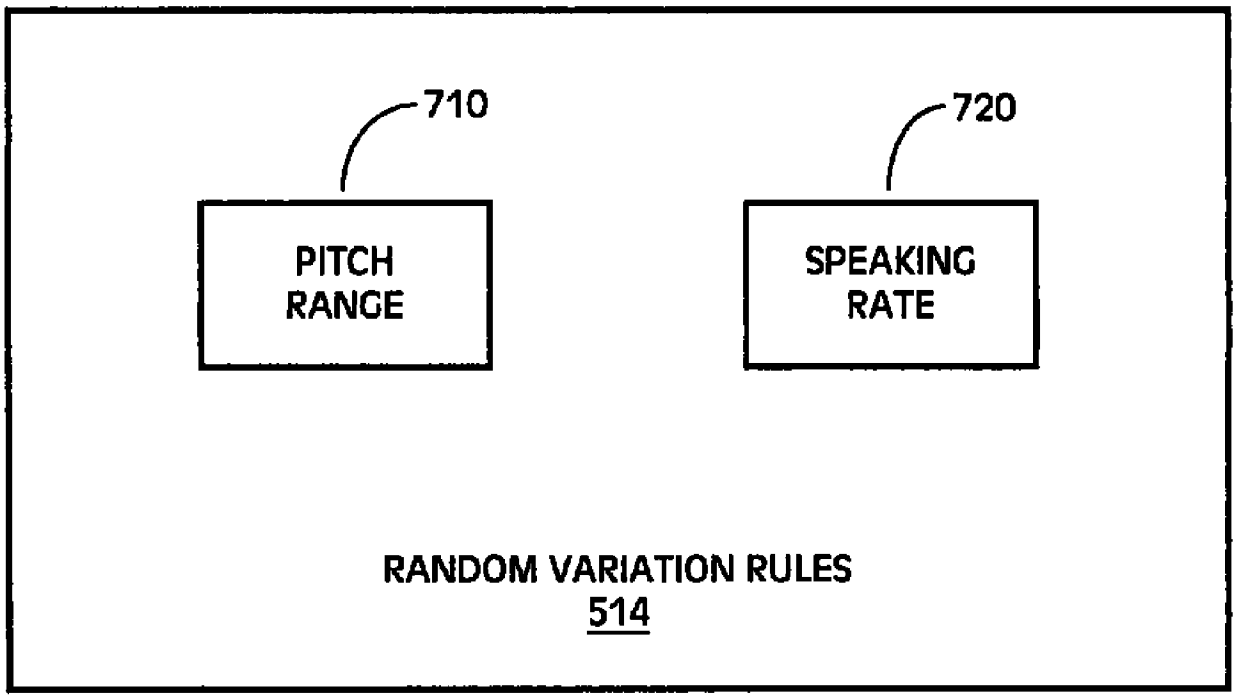
FIG. 7 is a block diagram of the random variation rules of a speech synthesis system of one embodiment.

FIG. 7 illustrates the random variation rules 514 stored on memory 404 in a speech synthesis system of one embodiment. An important aspect of the random variation rules is that their application to the acoustic sequence 601 of synthesized speech signals must not alter the linguistic prosodic features representative of the received text 104. There are two categories of random variation rules 514.

The first category is a slight random variation in the overall pitch range 710 within which the linguistically-motivated speech melody is mapped from its rule-generated symbolic transcription to the continuously-varying fundamental frequency values. The linguistically-motivated speech melody is a prosodic feature of the input text 104, and refers to the specific intonational tune of the spoken message, e.g. a question tune, a neutral declarative tune, an exclamation tune, and so on. The mapping of the rule-generated symbolic transcription to the continuously varying fundamental frequency values may include application of the prosody model 114 and, more specifically, the phoneme pitch model 130 and intonation rules 132 to provide pitch information for the phonemes that comprise the message. In one embodiment, a slight variation is achieved by raising the overall pitch range one semitone by applying a logarithmic transformation of $\log 12\sqrt{2}$ to the acoustic sequence 601 of synthesized speech signals. The logarithmic transformation of the signal alters the sound of the synthesized speech while preserving the prosodic features representative of the text input 104 such as the linguistically-motivated speech melody. Other types of transformations to the overall pitch range that preserve the linguistic prosodic features of the synthesized speech may be employed without exceeding the scope of the present invention.

The second category is a random variation in the overall speaking rate 720 of the spoken message. The overall speaking rate of a spoken message can be modeled independently of the relative durations of the speech segments (e.g. phonemes) within that message. Moreover, it has been shown that listeners perceive the overall speaking rate independently of the relative durations of the speech segments within the message. Therefore, changes to the overall speaking rate of a spoken message may be achieved without altering the linguistic prosodic features of phoneme duration as generated according to the prosody model 114 and, more specifically, according to the phoneme duration model 128. In one embodiment a random variation is achieved by either slightly speeding up or slowing down the overall speaking rate of a spoken message by applying a mathematical transformation to the acoustic sequence 601 of synthesized speech signals. In one embodiment the mathematical transformation may be a linear transformation such as a factor of 1.25 to increase the speaking rate by 25 percent. The linear transformation of the signal alters the sound of the synthesized speech while preserving the prosodic features representative of the text input 104 such as the relative duration of the phonemes. Other types of transformations to the overall speaking rate that preserve the linguistic prosody components of the synthesized speech may be employed without exceeding the scope of the present invention.

Figure 8:
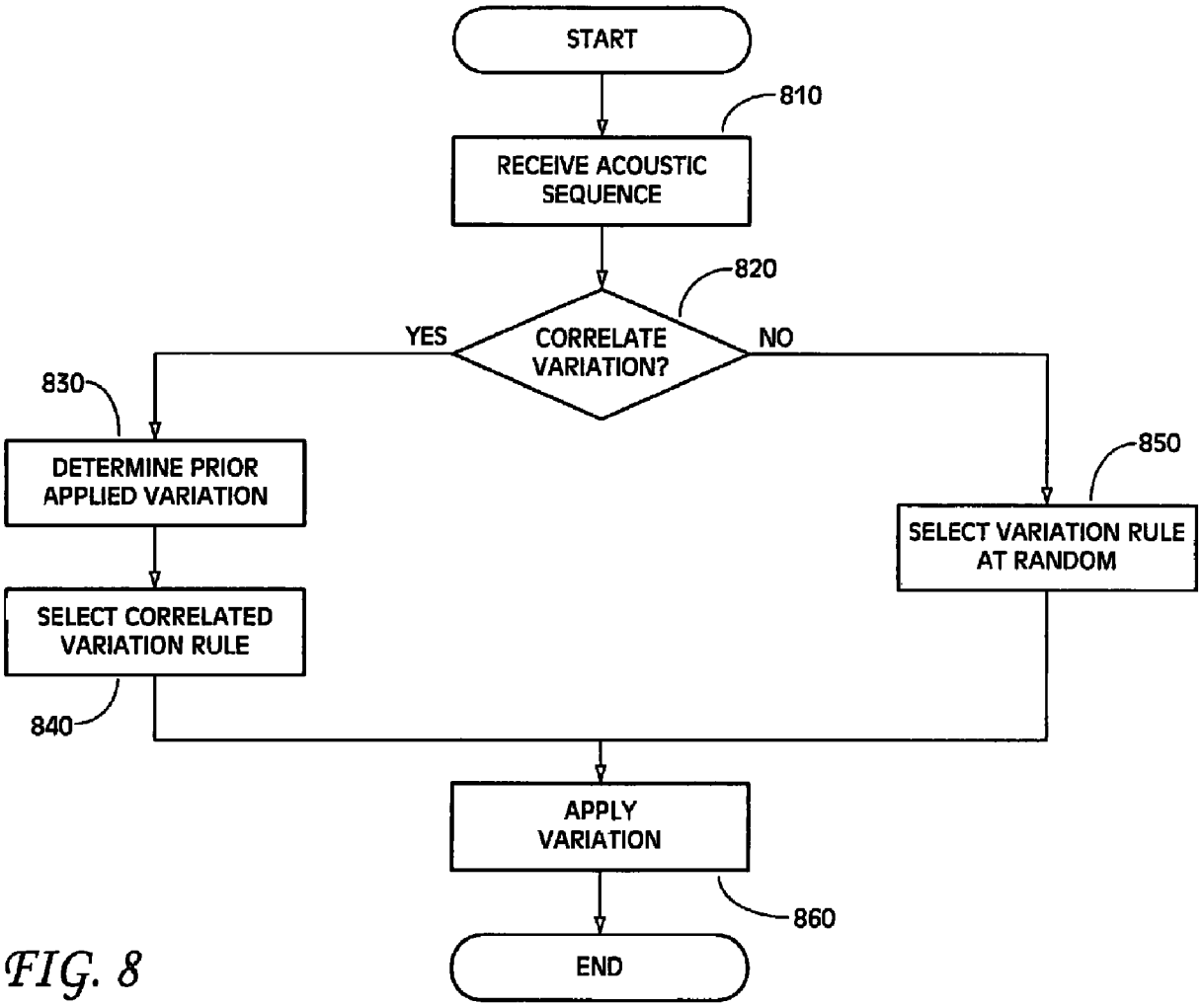
FIG. 8 is a flowchart for applying the random variation rules of one embodiment.

FIG. 8 illustrates a flowchart of the processes of a speech randomizer 508 and variation correlator 512 of a speech synthesis system of one embodiment. At process block 810 the speech randomizer 508 receives the acoustic sequence 601 of synthesized speech signals that embody the prosodic features representative of the received text 104. At process block 820, the speech randomizer determines whether to correlate the variation to the acoustic sequence 601 according to a parameter or other pre-determined setting of the speech synthesis system or user interface in which the synthesized speech is being used. If the application of the variation is to be correlated, then at process block 830 the variation correlator 512 determines whether there was a prior applied variation 516 stored on memory 404. If so, referring to block 840, then the variation correlator 512 selects a random variation rule 514 that correlates with the prior applied variation 516 to reflect a gradual change in the computer voice of the synthesized speech. If there is no prior applied variation rule 516 stored on memory 404, then the variation correlator 512 defaults to process block 850, where the speech randomizer 508 selects a variation rule at random. In one embodiment, the selection of a variation rule at random may be controlled in part by a parameter or other external setting of the speech synthesis system or user interface, such as a user preference for pitch modulation instead of speaking rate modulation. Even then, however, the selection of the actual variation rule will be selected at random so as to avoid predictability in the variation of the computer voice of the synthesized speech. Once the variation to be applied is determined, the processing continues at process block 860 where the speech randomizer 508 applies the selected random variation rule to the acoustic sequence 601 of synthesized speech signals without altering the linguistic prosodic features representative of the received text 104.

Thus, a method and apparatus for a speech synthesis system using random paralinguistic variation has been described. Whereas many alterations and modifications of the present invention will be comprehended by a person skilled in the art after having read the foregoing description, it is to be understood that the particular embodiments shown and described by way of illustration are in no way intended to be considered limiting. References to details of particular embodiments are not intended to limit the scope of the claims.

What is claimed is:

1. A method for producing synthetic speech comprising:

processing received text using a prosody model to produce prosodic features representative of the linguistic meaning of the received text;

generating an acoustic sequence of speech signals that represents the synthesized speech, the acoustic sequence having the prosodic features representative of the processed text;

determining a prior paralinguistic variation that has been applied to the acoustic sequence before a current paralinguistic variation; and applying the current paralinguistic variation which includes a mathematical transformation to the acoustic sequence overall, wherein the current paralinguistic variation is determined based on the prior paralinguistic variation, wherein the mathematical transformation does not alter the prosodic features representative of the linguistic meaning of the received text, wherein the current paralinguistic variation is applied to change the sound of the generated acoustic sequence of the speech signals.

2. The method of claim 1, further comprising selecting at least one of the plurality of paralinguistic variations; and applying the selected paralinguistic variation to the generated speech signals without altering the prosodic features representative of the linguistic meaning of the received text.

3. The method of claim 2, wherein the selected paralinguistic variation comprises a variation in an overall pitch range of the generated acoustic sequence of the speech signals.

4. The method of claim 3, wherein the prosodic features representative of the received text comprise a relative pitch value of each of the speech segments of the generated acoustic sequence of the speech signals, and wherein the application of the variation in the overall pitch range of the generated acoustic sequence of the speech signals does not alter the relative pitch values.

5. The method of claim 4, wherein the speech segments comprise one of phonemes, syllables, and words.

6. The method of claim 2, wherein the selected paralinguistic variation comprises a variation in a overall speaking rate of the generated acoustic sequence of the speech signals.

7. The method of claim 6, wherein the prosodic features representative of the received text comprise a relative duration of each of the speech segments of the generated acoustic sequence of the speech signals, and wherein the application of the variation in the overall speaking rate of the generated acoustic sequence of the speech signals does not alter the relative durations.

8. The method of claim 7, wherein the speech segments comprise one of phonemes, syllables, and words.

9. The method of claim 2, wherein the selection of the at least one of the plurality of paralinguistic variations is random.

10. The method of claim 2, wherein the selection of the at least one of the plurality of paralinguistic variations is correlated with the prior paralinguistic variation to reflect a gradual change in the sound of the generated acoustic sequence of the speech signals.

11. The method of claim 2, wherein a degree of the selected paralinguistic variation is altered before each application.

12. The method of claim 11, wherein the alteration of the degree of the selected paralinguistic variation is random.

13. The method of claim 11, wherein the alteration of the degree of the selected paralinguistic variation is correlated with the prior paralinguistic variation to reflect a gradual change in the sound of the generated acoustic sequence of the speech signals.

14. An apparatus for producing synthetic speech comprising:

means for receiving text into a circuit;

means for processing the received text using a prosody model to produce prosodic features representative of the linguistic meaning of the received text;

means for generating an acoustic sequence of speech signals representing the synthesized speech, the acoustic sequence having the prosodic features representative of the processed text;

means for determining a prior paralinguistic variation that has been applied to the acoustic sequence before a current paralinguistic variation; and means for applying the current paralinguistic variation which includes a mathematical transformation to the acoustic sequence overall, wherein the current paralinguistic variation is determined based on the prior paralinguistic variation, wherein the mathematical transformation does not alter the prosodic features representative of the linguistic meaning of the received text, wherein the current paralinguistic variation is applied to change the sound of the generated acoustic sequence of the speech signals.

15. The apparatus of claim 14, further comprising means for selecting at least one of the plurality of paralinguistic variations; and means for applying the selected paralinguistic variation to the generated acoustic sequence of the speech signals without altering the prosodic features representative of the linguistic meaning of the received text.

16. The apparatus of claim 15, wherein the selected paralinguistic variation comprises a variation in an overall pitch range of the generated acoustic sequence of the speech signals.

17. The apparatus of claim 16, wherein the comprise a relative pitch value of each of the speech segments of the generated acoustic sequence of the speech signals, and wherein the application of the variation in the overall pitch range of the generated acoustic sequence of the speech signals does not alter the relative pitch values.

18. The apparatus of claim 17, wherein the speech segments comprise one of phonemes, syllables, and words.

19. The apparatus of claim 15, wherein the selected paralinguistic variation comprises a variation in a overall speaking rate of the generated acoustic sequence of the speech signals.

20. The apparatus of claim 19, wherein the prosodic features representative of the received text comprise a relative duration of each of the speech segments of the generated acoustic sequence of the speech signals, and wherein the application of the variation in the overall speaking rate of the generated acoustic sequence of the speech signals does not alter the relative durations.

21. The apparatus of claim 20, wherein the speech segments comprise one of phonemes, syllables, and words.

22. The apparatus of claim 15, wherein the selection of the at least one of the plurality of paralinguistic variations is random.

23. The apparatus of claim 15, further comprising means for correlating the at least one of the plurality of paralinguistic variations with the prior paralinguistic variation to reflect a gradual change in the sound of the generated acoustic sequence of the speech signals.

24. The apparatus of claim 15, further comprising means for altering a degree of the selected paralinguistic variation before each application.

25. The apparatus of claim 24, wherein the alteration of the degree of the selected paralinguistic variation is random.

26. The apparatus of claim 24, further comprising means for correlating the degree of alteration of the selected paralinguistic variation with the prior paralinguistic variation to reflect a gradual change in the sound of the generated acoustic sequence of the speech signals.

27. An apparatus comprising:

a machine-accessible non-transitory medium storing executable instructions which, when executed in a machine, cause the machine to perform a method for synthesizing speech comprising:

processing received text using a prosody model to produce prosodic features representative of the linguistic meaning of the received text;

generating an acoustic sequence of speech signals representing the synthesized speech, the acoustic sequence having the prosodic features representative of the processed text;

determining a prior paralinguistic variation that has been applied to the acoustic sequence before a current paralinguistic variation; and applying the current paralinguistic variation which includes a mathematical transformation to the acoustic sequence overall, wherein the current paralinguistic variation is determined based on the prior paralinguistic variation, wherein the mathematical transformation does not alter the prosodic features representative of the linguistic meaning of the received text, wherein the current paralinguistic variation is applied to change the sound of the generated acoustic sequence of the speech signals.

28. The apparatus of claim 27, further comprising selecting at least one of the plurality of paralinguistic variations; and applying the selected paralinguistic variation to the generated acoustic sequence of the speech signals without altering the prosodic features representative of the linguistic meaning of the received text.

29. The apparatus of claim 28, wherein the selected paralinguistic variation comprises a variation in an overall pitch range of the generated acoustic sequence of the speech signals.

30. The apparatus of claim 29, wherein the prosodic features representative of the received text comprise a relative pitch value of each of the speech segments of the generated acoustic sequence of the speech signals, and wherein the application of the variation in the overall pitch range of the generated acoustic sequence of the speech signals does not alter the relative pitch values.

31. The apparatus of claim 28, wherein the selected paralinguistic variation comprises a variation in a overall speaking rate of the generated acoustic sequence of the speech signals.

32. The apparatus of claim 31, wherein the prosodic features representative of the received text comprise a relative duration of each of the speech segments of the generated acoustic sequence of the speech signals, and wherein the application of the variation in the overall speaking rate of the generated acoustic sequence of the speech signals does not alter the relative durations.

33. The apparatus of claim 28, wherein the selection of the at least one of the plurality of paralinguistic variations is random.

34. The apparatus of claim 28, wherein the selection of the at least one of the plurality of paralinguistic variations is correlated with the prior paralinguistic variation to reflect a gradual change in the sound of the generated acoustic sequence of the speech signals.

35. An apparatus for speech synthesis comprising:

an input for receiving text signals; and a circuit coupled to the input, the circuit configured to synthesize an acoustic sequence representing a synthesized speech, the acoustic sequence having one or more of a plurality of prosodic features representative of the linguistic meaning of the received text signals, to determine a prior paralinguistic variation that has been previously applied to the acoustic sequence; and to paralinguistically vary the synthesized acoustic sequence overall without altering the plurality of prosodic features that include relative pitch values of speech segments in the generated acoustic sequence, wherein paralinguistically varying the synthesized acoustic sequence comprises selecting at least one current paralinguistic variation from a plurality of paralinguistic variations based on the prior paralinguistic variation; and applying the selected current paralinguistic variation which includes a mathematical transformation to the synthesized acoustic sequence overall, wherein the mathematical transformation does not alter the plurality of prosodic features representative of the linguistic meaning of the received text signals associated with individual phonemes in the acoustic sequence.

36. The apparatus of claim 35, wherein the selected paralinguistic variation comprises a variation in an overall pitch range of the synthesized acoustic sequence.

37. The apparatus of claim 36, wherein the prosodic features representative of the received text signal comprise a relative pitch value of each of the speech segments of the synthesized acoustic sequence, and wherein the application of the variation in the overall pitch range of the synthesized acoustic sequence does not alter the relative pitch values.

38. The apparatus of claim 37, wherein the speech segments comprise one phonemes, syllables, and words.

39. The apparatus of claim 35, wherein the selected paralinguistic variation comprises a variation in a overall speaking rate of the synthesized acoustic sequence.

40. The apparatus of claim 39, wherein the prosodic features representative of the received text signal comprise a relative duration of each of the speech segments of the synthesized acoustic sequence, and wherein the application of the variation in the overall speaking rate of the synthesized acoustic sequence, does not alter the relative durations.

41. The apparatus of claim 40, wherein the speech segments comprise one of phonemes, syllables, and words.

42. The apparatus of claim 35, wherein the selection of the at least one of the plurality of paralinguistic variations is random.

43. The apparatus of claim 35, wherein the selection of the at least one of the plurality of paralinguistic variations is correlated with the prior to the acoustic sequence to reflect a gradual change in the sound of the synthesized acoustic sequence.

44. The apparatus of claim 35, wherein a degree of the selected paralinguistic variation is altered before each application.

45. The apparatus of claim 44, wherein the alteration of the degree of the selected paralinguistic variation is random.

46. The apparatus of claim 44, wherein the alteration of the degree of the selected paralinguistic variation is correlated with the prior paralinguistic variation to reflect a gradual change in the sound of the synthesized acoustic sequence.

47. The apparatus of claim 35, wherein the circuit comprises a processing device.

48. A speech synthesis process implemented in a machine comprising:

generating an acoustic speech output representing a synthesized speech in response to an input text, wherein the acoustic speech output comprises one or more of a plurality of prosodic features representative of the linguistic meaning of the input text; and varying the generated acoustic speech output without altering the plurality of prosodic features that include relative pitch values of speech segments in the generated acoustic sequence, wherein varying the generated acoustic speech output comprises determining a prior paralinguistic variation that has been previously applied to the acoustic sequence;

selecting at least one current paralinguistic variation from a plurality of paralinguistic variations based on the prior paralinguistic variation; and applying the selected current paralinguistic variation which includes a mathematical transformation to the generated acoustic speech output overall, wherein the mathematical transformation does not alter the plurality of prosodic features representative of the linguistic meaning of the input text.

49. The process of claim 48, wherein the selected paralinguistic variation comprises a variation in an overall pitch range of the generated speech output.

50. The process of claim 49, wherein the prosodic features representative of the input text comprise a relative pitch value of each of the speech segments of the generated speech output, and wherein the application of the variation in the overall pitch range of the generated speech output does not alter the relative pitch values.

51. The process of claim 48, wherein the selected paralinguistic variation comprises a variation in a overall speaking rate of the generated speech output.

52. The process of claim 51, wherein the prosodic features representative of the input text comprise a relative duration of each of the speech segments of the generated speech output, and wherein the application of the variation in the overall speaking rate of the generated speech output, does not alter the relative durations.

53. The process of claim 48, wherein the selection of the at least one of the plurality of paralinguistic variations is random.

54. The process of claim 48, wherein the selection of the at least one of the plurality of paralinguistic variations is correlated with the prior paralinguistic variation to reflect a gradual change in the sound of the generated speech output.

55. The process of claim 48, wherein a degree of the selected paralinguistic variation is altered before each application.

56. The process of claim 55, wherein the alteration of the degree of the selected paralinguistic variation is random.

57. The process of claim 55, wherein the alteration of the degree of the selected paralinguistic variation is correlated with the prior paralinguistic variation to reflect a gradual change in the sound of the generated speech output.

58. A method for generating a paralinguistic model for use in a speech synthesis system, the method comprising:

developing, by a processor, one or more of a plurality of paralinguistic variations which include a mathematical transformation that, when applied to a synthesized acoustic sequence of the speech signals representing a synthesized speech, the synthesized acoustic sequence having prosodic features representative of a received text, change the sound of the synthesized acoustic sequence while preserving the prosodic features representative of the linguistic meaning of the received text, wherein the developing includes determining, by the processor, a prior paralinguistic variation that has been previously applied to the synthesized acoustic sequence, wherein at least one of the plurality of paralinguistic variations is developed based on the prior paralinguistic variation.

59. The method of claim 58, wherein the plurality of paralinguistic variations includes one of a variation of an overall pitch range and a variation of an overall speaking rate of the synthesized speech.

60. A speech synthesis system comprising:

a voice generation device including a processor for outputting an acoustic phoneme sequence having prosodic features representative of a text; a duration modeling device that provides relative phoneme durations using a phoneme duration model to the voice generation device;

a pitch modeling device coupled to said duration modeling device that, using a pitch model, provides a relative phoneme pitch value for the at least one phoneme to the voice generation device; and a variation modeling device coupled to the voice generation device that receives the acoustic sequence of synthesized speech signals having the prosodic features including the relative phoneme durations and the relative pitch values from the voice generation device; determines a prior paralinguistic variation that has been previously applied to the acoustic sequence; and, using a paralinguistic variation model selected based on the prior paralinguistic variation, varies an overall speaking rate and an overall pitch range of the acoustic sequence of synthesized speech signals by applying a mathematical transformation to the acoustic sequence of synthesized speech signals having the prosodic features overall, wherein the mathematical transformation varies the overall speaking rate and the overall pitch rate without altering the prosodic features.

61. The system of claim 60, wherein the variation modeling device varies the overall speaking rate by applying a linear transformation to the acoustic sequence of synthesized speech signals.

62. The system of claim 60, wherein the variation modeling device varies the overall pitch range by applying a logarithmic transformation to the acoustic sequence of synthesized speech signals.

* * * * *